US008568143B2

(12) United States Patent
Uhr

(10) Patent No.: US 8,568,143 B2
(45) Date of Patent: Oct. 29, 2013

(54) TRAINING BARREL

(76) Inventor: Oren Louis Uhr, Rishon Le-Zion (IL)

( * ) Notice: Subject to any disclaimer, the term of this patent is extended or adjusted under 35 U.S.C. 154(b) by 0 days.

(21) Appl. No.: 13/106,842

(22) Filed: May 12, 2011

(65) Prior Publication Data

US 2011/0281243 A1 Nov. 17, 2011

Related U.S. Application Data

(60) Provisional application No. 61/334,203, filed on May 13, 2010.

(51) Int. Cl.
*F41A 33/00* (2006.01)

(52) U.S. Cl.
USPC ..... 434/16; 434/11

(58) Field of Classification Search
USPC ..... 434/11–27; 42/116; 82/29
See application file for complete search history.

(56) References Cited

U.S. PATENT DOCUMENTS

| | | | | |
|---|---|---|---|---|
| 3,388,665 | A | 6/1968 | Koehler | |
| 4,048,489 | A | 9/1977 | Giannetti | |
| 4,678,437 | A | 7/1987 | Scott et al. | |
| 4,983,123 | A * | 1/1991 | Scott et al. | 434/21 |
| 5,119,576 | A | 6/1992 | Erning | |
| 5,344,320 | A | 9/1994 | Inbar et al. | |
| 5,359,937 | A | 11/1994 | Dittrich | |
| 5,363,769 | A | 11/1994 | Bellak et al. | |
| 5,488,795 | A | 2/1996 | Sweat | |
| 5,599,187 | A | 2/1997 | Mesiano | |
| 5,636,992 | A | 6/1997 | Mastrangelo | |
| 5,685,106 | A | 11/1997 | Shoham | |
| 5,842,300 | A | 12/1998 | Cheshelski et al. | |
| 5,909,951 | A | 6/1999 | Johnsen et al. | |
| 6,070,992 | A | 6/2000 | Schnell | |
| 6,322,365 | B1 | 11/2001 | Shechter et al. | |
| 6,579,098 | B2 | 6/2003 | Shechter | |

(Continued)

FOREIGN PATENT DOCUMENTS

| | | | |
|---|---|---|---|
| EP | 0 467 090 | A1 | 1/1992 |
| WO | WO 2005/086592 | A2 | 9/2005 |
| WO | WO 2007/057890 | A2 | 5/2007 |
| WO | WO 2007/060655 | A2 | 5/2007 |

OTHER PUBLICATIONS

Richard Mann, Laser Accuracy, Shooting Illustrated, Jun. 2011.

(Continued)

*Primary Examiner* — Timothy A Musselman
(74) *Attorney, Agent, or Firm* — Law Office of Arthur M. Antonelli, PLLC

(57) ABSTRACT

A training barrel having a central axis for housing a light emitting insert which includes an elongate member having a first end, a second end, and a first internal surface. The first internal surface extends from the first end to the second end. The internal surface includes a first segment which defines a first volume having a first cross sectional area perpendicular to the central axis, a second segment adjacent the first segment which defines a second volume having a second cross sectional area perpendicular to the central axis, and a third segment proximate the second segment which defines a third volume having a third cross sectional area perpendicular to the central axis, the third cross sectional area being greater than the second cross sectional area. The third segment may be configured and dimensioned to receive a light emitting insert and the first segment may be configured and dimensioned to receive a blank cartridge.

19 Claims, 7 Drawing Sheets

(56) References Cited

U.S. PATENT DOCUMENTS

| | | | | |
|---|---|---|---|---|
| 6,604,064 | B1 | 8/2003 | Wolff et al. | |
| 6,799,971 | B2 | 10/2004 | Healy et al. | |
| 6,869,285 | B1 | 3/2005 | Jones, II | |
| 6,966,775 | B1 | 11/2005 | Kendir et al. | |
| 2002/0012898 | A1 | 1/2002 | Shechter et al. | |
| 2002/0057719 | A1 | 5/2002 | Shechter | |
| 2003/0003424 | A1* | 1/2003 | Shechter et al. | 434/21 |
| 2003/0136900 | A1 | 7/2003 | Shechter et al. | |
| 2005/0191601 | A1 | 9/2005 | Dvorak | |

OTHER PUBLICATIONS

General Dynamics, Ordnance and Tactical Systems-Canada, Training for the Real World, 2007.

General Dynamics, Ordnance and Tacticalsystems-Canada, Safe and Sound with 9mm and 5.56mm SecuriBlank, 2010.

General Dynamics, Ordnance and Tactical Systems-Canada, Simunition Weapon Conversion Kits, 2010.

* cited by examiner

TRAINING BARREL

CROSS REFERENCE TO RELATED APPLICATIONS

This application claims the benefit of U.S. Provisional Application No. 61/334,203 filed on May 13, 2010. U.S. Provisional Application No. 61/334,203 is incorporated by reference herein in its entirety.

FIELD OF THE INVENTION

The present invention generally relates to a firearm training aid, and more particularly this invention relates to a firearm barrel that is configured for use with a blank cartridge and a light emitting training device to operatively simulate live fire training. This invention also relates to a system for registering "hits" during dry-fire exercises and/or gaming with a hand-held firearm.

BACKGROUND

A cartridge, also called a round, generally packages a bullet, propellant (e.g., smokeless powder or gunpowder) and primer into a single metallic case precisely made to fit the firing chamber of a firearm. The primer, typically, is a small charge of an impact-sensitive chemical that may be located at the center of the case head (centerfire ammunition) or at its rim (rimfire ammunition). In use, the cartridge case seals a firing chamber in all directions except down the bore, A firing pin strikes the primer, igniting it. A jet of burning gas from the primer ignites the powder. Gases from the burning powder (deflagration) expand the case to seal it against the chamber wall. The projectile is then pushed down the barrel in the direction that has least resistance to this pressure. After the projectile leaves the barrel, the pressure drops, allowing the cartridge case to contract slightly, easing its removal from the chamber.

A blank is a charged cartridge that does not contain a projectile. To contain the propellant, the opening where the projectile would be is crimped shut or sealed with some material that disperses rapidly on leaving the barrel. A blank cartridge is discussed in U.S. Pat. No. 5,359,937, which is incorporated herein by reference.

A light emitting cartridge typically shines a collimated pulse of coherent electromagnetic radiation on a target when a gun loaded with the cartridge is fired. A light emitting cartridge is discussed in U.S. Pat. No. 5,685,106, which is incorporated herein by reference.

Dry fire training—repeated drawing, aiming and firing without ammunition—is a practical and convenient way to improve and/or maintain shooting techniques. The practice is limited, however, by the fact that the bullet impact point is a mere assumption; thus the trainees and/or trainers are limited in their ability to evaluate the trainees' performance or/and improve their skills. Furthermore, there has long existed the need for an apparatus and system whereby a single or multiple user, or trainer and trainee can readily practice using a firearm without placing themselves or others at risk of accidental discharge of the firearm while still maintaining the ability to recognize the "hits." This safety imperative coincides with an added desire to limit the financial burden related to the wear and tear on a firearm, including cost of ammunition and use of adequate facilities brought about by live fire training.

These considerations have proven to be especially relevant to law-enforcement and military personnel, who require a high degree of firearm practice and proficiency. In such situations, "Force on Force" drills pose a heightened risk to users, as the muzzle of firearm points toward other users, increasing the likelihood of accidental and potentially fatal discharge. It is well documented that Training Officers (TOO have been injured or fatally wounded due to several loading/unloading, procedures, such that a live round reaches the chamber of a firearm without the fellow officer being able to discern that he is facing a loaded weapon.

Accordingly, a need exists for a firearm training system that addresses these concerns and maintains the overall benefit of live fire training.

SUMMARY

Hence, the present invention is directed to a firearm barrel that houses a light emitting device for use in a laser training system, as well as a firing chamber that accommodates blanks for simulating physical conditions associated with live fire training.

One aspect of the present invention is directed to a training barrel having a central axis for housing alight emitting insert which includes an elongate member having a first end, a second end, and a first internal surface extending from the first end through the elongate member to the second end. The first internal surface may include a first segment abutting the first end which defines a first volume having a first cross sectional area perpendicular to the central axis. The first internal surface also may include a second segment adjacent the first segment which defines a second volume having a second cross sectional area perpendicular to the central axis, the second cross sectional area being less than the first cross sectional area. The first internal surface may include a third segment proximate the second segment which defines a third volume having a third cross sectional area perpendicular to the central axis, the third cross sectional area being greater than the second cross sectional area. Additionally, the first internal surface may include a fourth segment situated between the third segment and the second end which defines a fourth volume having a fourth cross sectional area perpendicular to the central axis, the fourth cross sectional area being less than the third cross sectional area.

The elongate member may be separable into a proximal part and a distal part, and the first, second, and third segments may be disposed in the proximal part and the fourth segment may be disposed in the distal part. The proximal part may include a first screw thread, and the distal part may include a second screw thread such that the second screw thread and the first screw thread mate to secure the distal part to the proximal part. The first screw thread may be proximate the third segment and the second screw thread may be proximate the fourth segment. In addition, the proximal part may further include an exterior surface and a second interior surface which extends from the exterior surface to the first screw thread. The distal part may include a third interior surface which extends toward the first interior surface from the second screw thread. A fastening element may be disposed in the second and third interior surfaces.

Also, the third segment may be configured and dimensioned to receive a light emitting insert, and the fourth and second segments may be configured and dimensioned to secure a light emitting insert in the third segment. Moreover, the first segment may be configured and dimensioned to receive a source of compressed gas. For instance, the first segment may be configured and dimensioned to receive a blank cartridge.

The elongate member may further include a fifth segment disposed between the fourth segment and the third segment which defines a fifth volume having a fifth cross sectional area perpendicular to the central axis, the fifth cross sectional area being greater than the fourth cross sectional area. The fifth segment may be located in the distal pan.

The elongate member may further include a sixth segment disposed between the fourth segment and the second end which defines a sixth volume having a sixth cross sectional area perpendicular to the central axis, the sixth cross sectional area being greater than the fourth cross sectional area. The second segment may include a vent in fluid communication with the sixth segment.

The first segment may have circular cylindrical shape and the diameter of the first cross sectional area may be between approximately 0.1 inches and 0.5 inches. The distance between the first and second end may be between approximately 3 inches and 6 inches, and the elongate member may be formed from an alloy. The elongate member may be a drop in replacement part for a handgun.

DESCRIPTION OF THE DRAWINGS

In the accompanying drawings, which form part of this specification and are to be read in conjunction therewith and in which like reference numerals are used to indicate like parts in the various views.

DESCRIPTION

Figure 1:
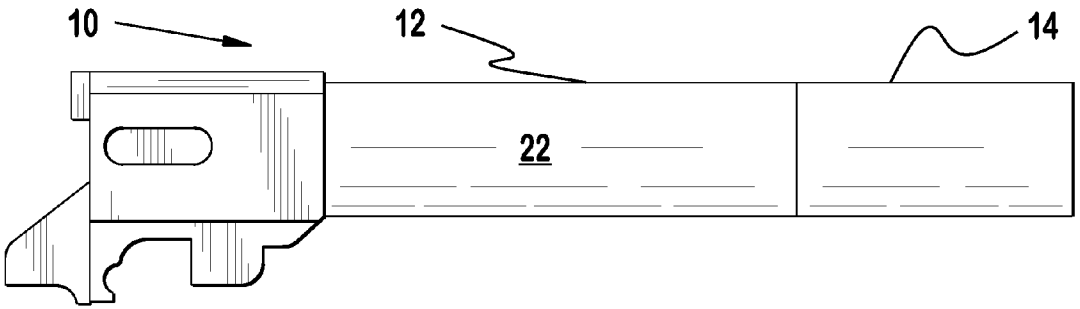
FIG. 1 is a front view of an exemplary embodiment of the firearm training barrel of the present invention.
Figure 2:
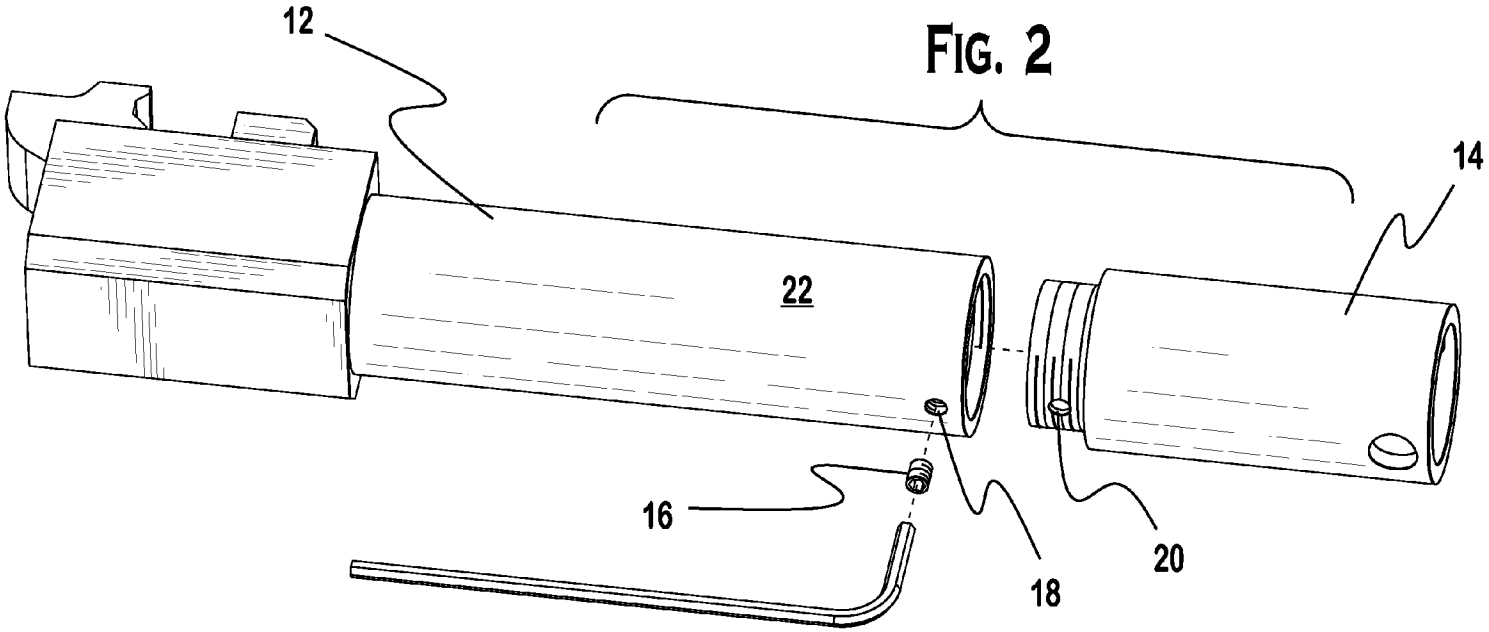
FIG. 2 is ail exploded view of the firearm training barrel of FIG. 1 from a top rear perspective.

FIGS. 1 and 2 illustrate a substitute firearm barrel (or training barrel) 10 that is configured to receive projectile-less munitions (or blank cartridges) and exchangeable light emitting munitions (or light emitting cartridges). The training barrel may be used as a conversion barrel for a service weapon in order to simulate live tire training. The training barrel 10 preferably has an outline (or profile) which matches that of the service weapon barrel, so as to provide a drop-in replacement part for the original firearm barrel. In accordance with the embodiment disclosed in FIG. 1, the training barrel may be a modified 9 mm Simunition® conversion barrel for a Glock Model 19 pistol. The training barrel, however, may be formed from any durable, high strength material suitable for this application. For example, the training barrel may be formed from an alloy, such as a chromium-molybdenum steel (e.g., SAE, Grade 4140) or stainless steel (e.g., SAE, Type 416).

As shown in FIG. 2, the training barrel 10 may include a proximal part 12 and a removable distal part 14 that may be screwed into the proximal part. Additionally, the distal part 14 may be secured to the proximal part 12 by a fastener 16. For instance, the fastener 16 may be a headless screw that is inserted into threads 18 and 20, until it is level with (or below) the exterior surface of the proximal part 12. In another embodiment, the threaded portion 20 of the distal part 14 may be replaced with a smooth bore or groove.

Figure 3:
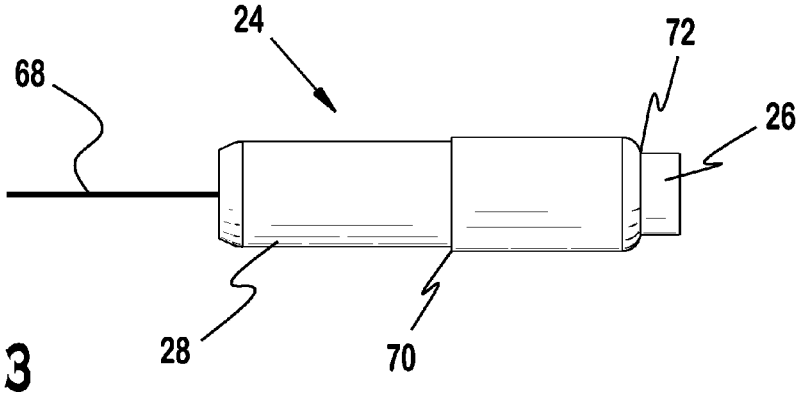
FIG. 3 is a side view of an illustrative light emitting device that may be disposed within the firearm training barrel of FIG. 1.

Referring to FIG. 3, alight emitting munition (or light emitting cartridge) 24 may be inserted into the training barrel 10. The tight emitting cartridge may have cylindrical shape and include an actuator 26 and a light emitting mechanism 28. Internally, the light emitting mechanism may further include a laser source and electric driver circuitry (not shown).

Figure 11:
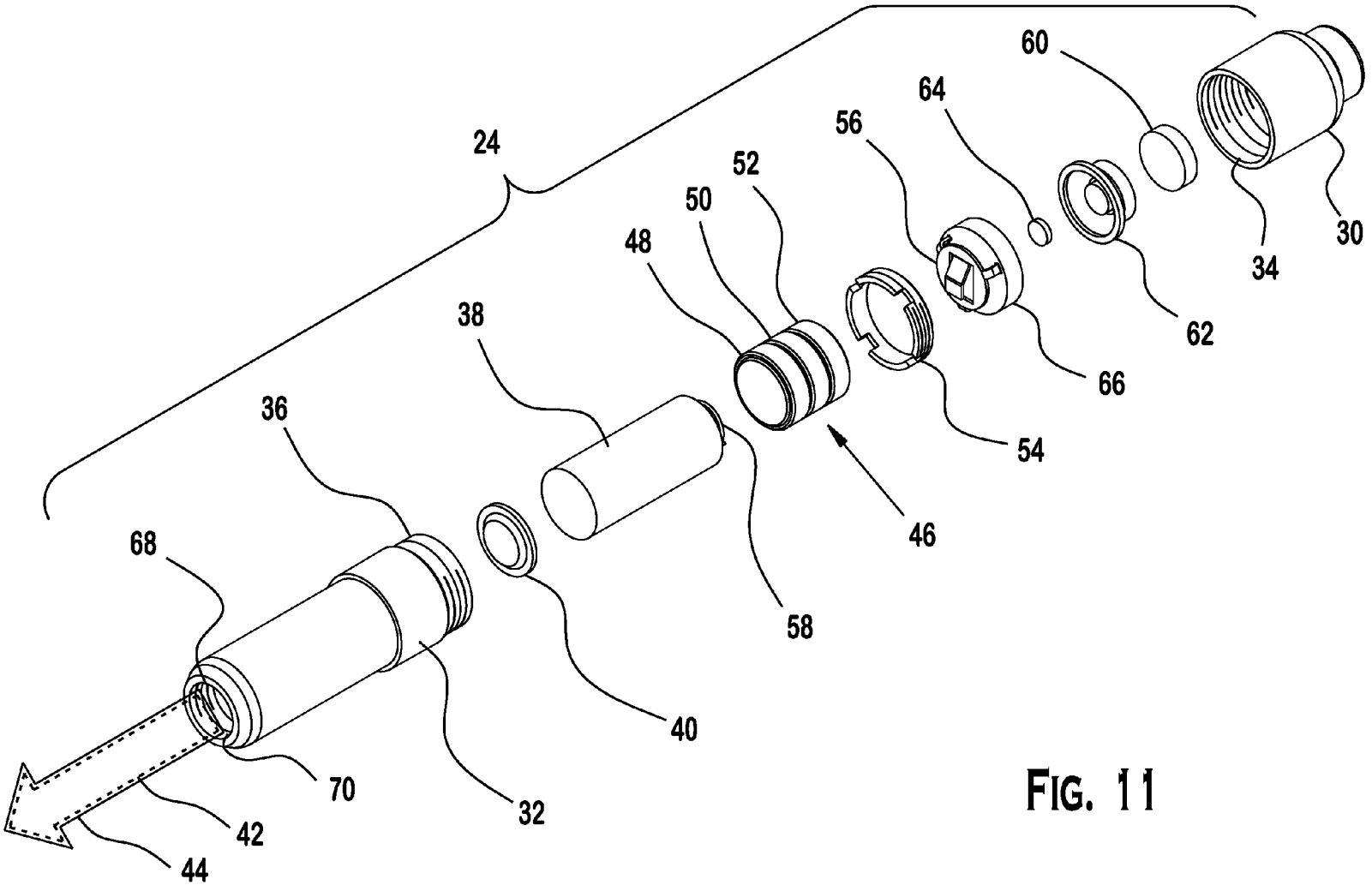
FIG. 11 is an exploded view of the light emitting cartridge of FIG. 3.

As shown in FIG. 11, the light emitting cartridge 24 may include a first casing 30, a second casing 32, a securing mechanism 34, a complementary securing mechanism 36, an illuminator 38 and lens 40 which emit and focuses a first wavelength of light and a second wavelength of light 44, a power supply 46, a battery 48, 50, 52, a securing ring 54, a control circuit bias 56, a spring 58, a firing pad 60, a bell-shaped absorbent material 62, a conductive pin 64, a control circuit 66, an accessory attachment element 68, and an accessory indicator 70. The light emitting cartridge of FIG. 11 is disclosed in commonly owned, co-pending U.S. patent application Ser. No. 13/008,234, entitled "Dry Fire Training Device," filed on Jan. 18, 2011, U.S. patent application Ser. No. 13/008,234 is incorporated herein in its entirety. Although the first and second casing may be shaped like a cartridge, the light emitting insert may take any suitable form provided that it may be securely held within the training barrel so as to prevent the insert from separating from the training barrel during use. Additionally, the bell shaped absorbent material and conductive pin may be replaced with a vibration sensor (e.g. a multiple axis accelerometer) cooperates with the control circuit to recognize the discharge of a blank cartridge and actuate the light emitting insert.

Referring back to FIG. 3, the light emitting mechanism 28 may emit a pulse of light in the form of a laser beam 68, in response to mechanical pressure applied to the actuator 26. The light pulse may be of a predetermined nature, which can be adjusted by the electric driver circuitry. In one embodiment, the light emitting mechanism 28 may emit generally monochromatic "red" light and have a dominant wavelength between approximately 610 nm and 760 nm. For instance, the light emitting mechanism may include a laser diode that emits light at approximately 635 nm or 650 nm. Additionally, the case (or exterior surface) of the light emitting cartridge 24 may include an abrupt gradation 70 and a tapered gradation 72 for fixing the case between by mating gradations (or portions) formed in the proximal part 12 and the removable distal part 14.

Figure 4:
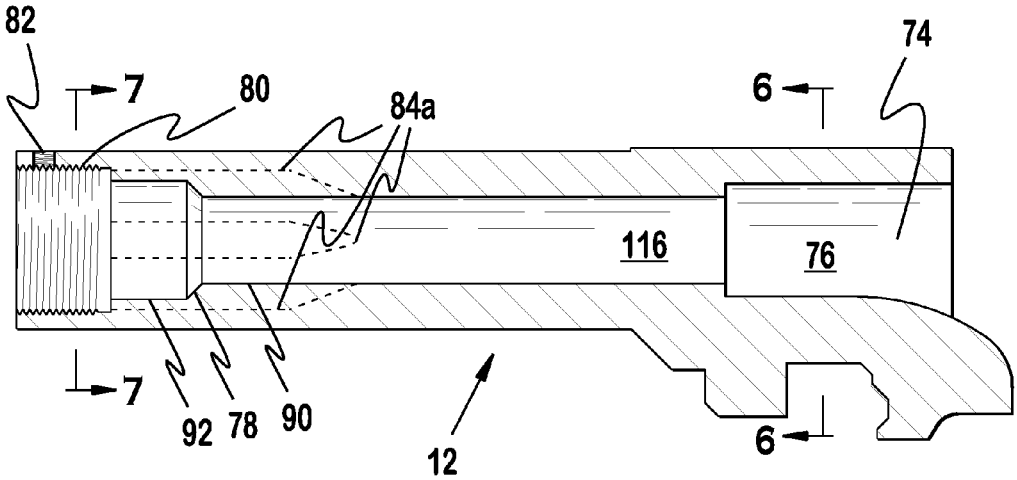
FIG. 4 is a cross-sectional view of the proximal part of the firearm training barrel of FIG. 1.

FIG. 4 is a cross-sectional view of the proximal part 12. In its proximal end (the end that is closer to the striker of the firearm), the proximal part 12 includes a chamber 74, into which a blank cartridge (not shown) that matches the caliber of the firearm barrel is inserted. The chamber 74 may have a sidewall 76. A first annular groove 78, formed in the distal end of the proximal part 12, may be adapted to receive the actuator 26 of the light emitting munitions 24. The first annular groove may be situated between two sidewall segments 90, 92 which differ in internal dimension. The distal end of the proximal part 12 also may include an inner circumferential thread 80 for receiving a mating thread on the distal part 14. A perpendicular thread 82 may be formed in the wall of the proximal part 12, so as to receive a fastener, such as a headless screw 16. One or more passages 84*a* may be formed in the wall of proximal part 12, so as to provide a passageway for hot gases and polluting particles to discharge.

Figure 5:
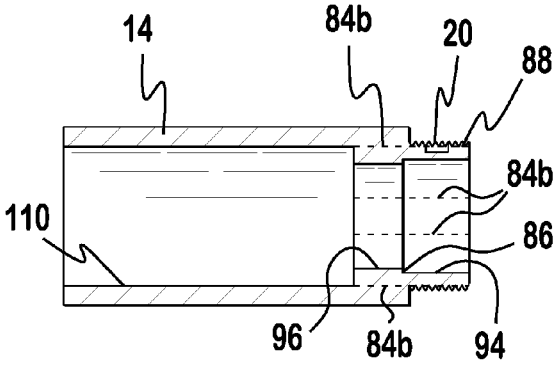
FIG. 5 is a cross-sectional view of the distal part of the firearm training barrel of FIG. 1.
Figure 13:
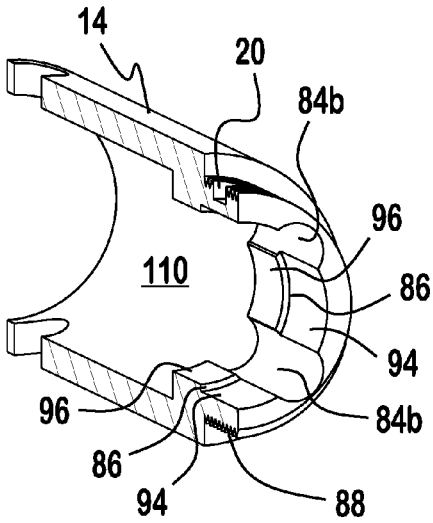
FIG. 13 is a partial sectional view of the distal part of FIG. 2.

Referring to FIGS. 5 and 13*a* second annular groove 86, adapted to receive the lighting end (or light emitting end) 28 of the light emitting cartridge (or light emitting insert) 24, may be formed in the proximal end of the distal part 14. The second annular groove may be situated between two sidewalls segments 94, 96 which differ in internal dimension. The proximal end of the distal part 14 also may include an outer circumferential thread 88 that is to be received in mating thread 80 of the proximal part 12. Discharge passages 84*b* (or vents) may be formed in the wall of distal part 14, so as to allow excess hot gases and polluting particles to continue discharging from the barrel.

Figure 6:
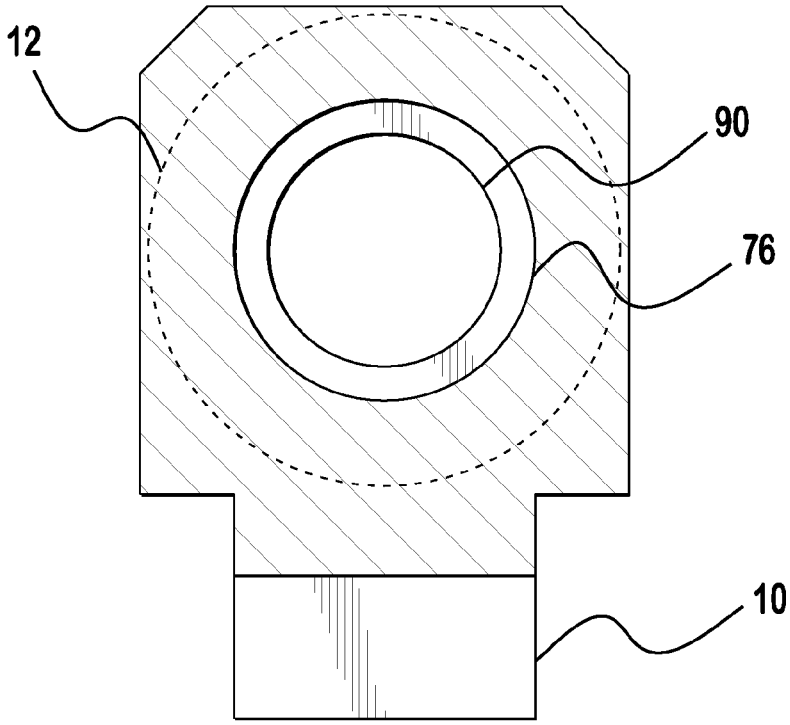
FIG. 6 is a cross-sectional view of the proximal part along line 6-6 in FIG. 4.
Figure 7:
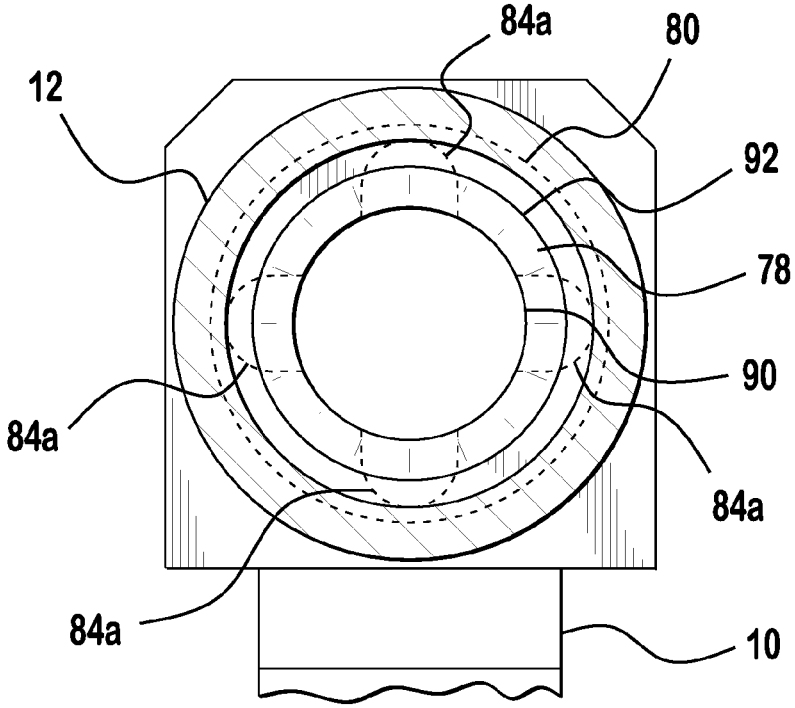
FIG. 7 is a cross-sectional view of the proximal part along line 7-7 in FIG. 4.
Figure 8:
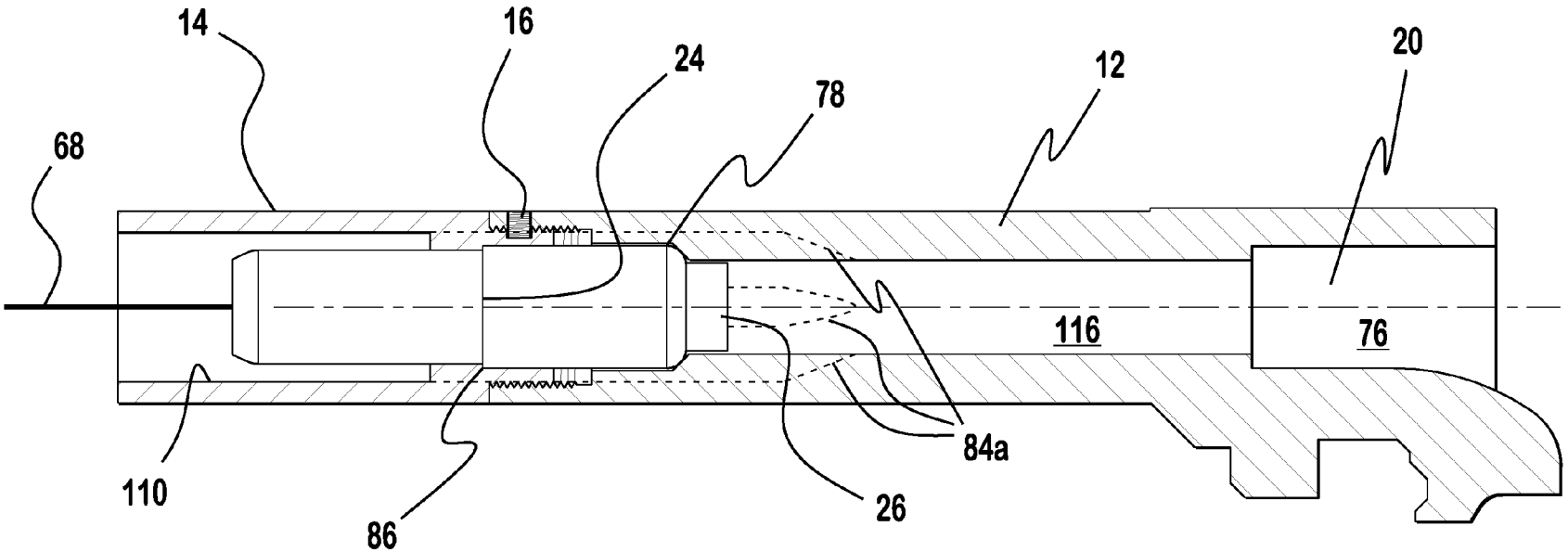
FIG. 8 is a schematic of the light emitting device of FIG. 3 disposed within the proximal and distal parts of the firearm training barrel of FIG. 1.
Figure 9:
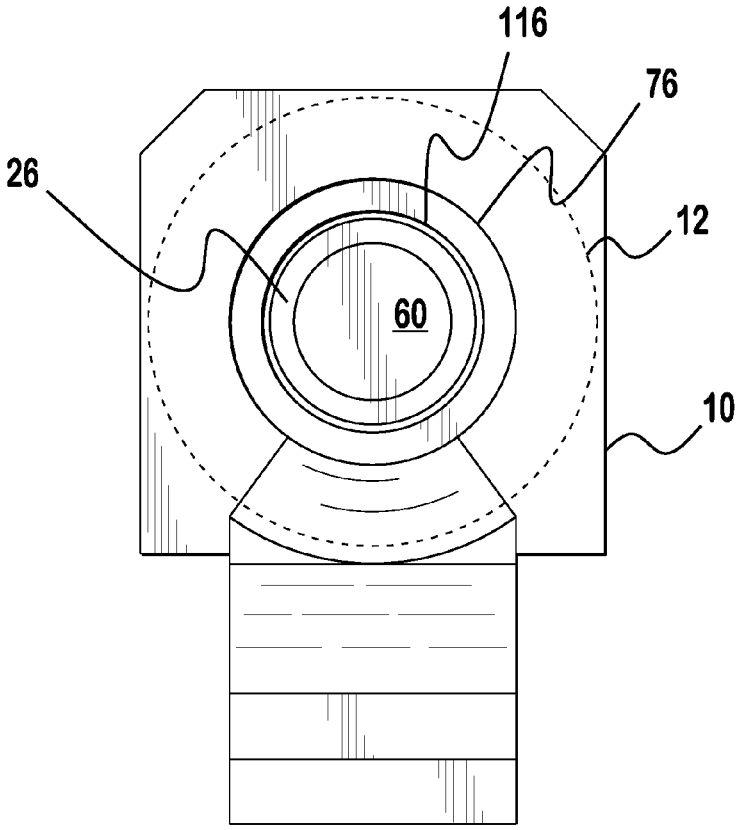
FIG. 9 is left side view of the firearm training barrel of FIG. 1.
Figure 10:
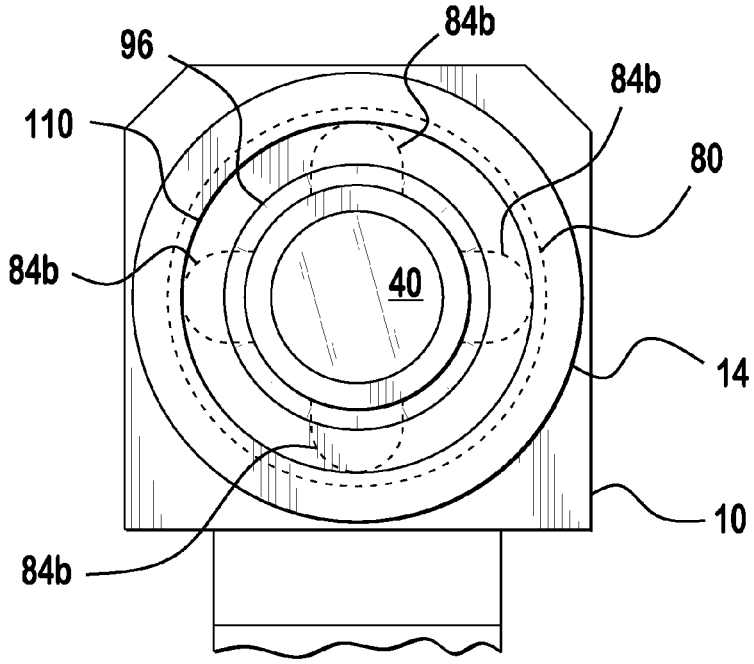
FIG. 10 is right side view of the firearm training barrel of FIG. 1.

A perpendicular thread (or groove) 20 may be formed in the wall of the distal part 14, so as to receive the tip of the headless screw 16 and to lock distal part 14 to the proximal part 12. As shown in FIG. 6, discharge passages 84*a* in the wall of proximal part 12 are aligned with the discharge passages 84*b* in the wall of distal part 14 so as provide a continuous passageway for venting the barrel. In another embodiment, the discharge passages may be directed into two longitudinal openings in the barrel of the pistol. For instance, the longitudinal openings may be arranged in a "V-position" on the upper portion of the barrel as in a Glock "C" compensator pistol. In another embodiment, the discharge passages may include multiple ports which exit the barrel. In yet another embodiment, the training barrel may be implemented for use in an Airsoft weapon or toy in which the weapon or toy creates (or supplies) the increase in barrel pressure required to actuate the light emitting device, eliminating the need for a blank cartridge in applications where smoke or ejection of cartridge cases may not be desired.

FIG. 6 is a cross-sectional view of an assembled training barrel 10 with a light emitting cartridge 24 disposed between the proximal part 12 and the distal part 14. In this embodiment, the light emitting cartridge 24 is disposed in the first annular groove 78 and the distal part 14 is screwed to the proximal part 12 so as to fix the light emitting cartridge 24 within the barrel 10 while positioning and holding the central axis of the light emitting cartridge in alignment with the central axis of the barrel. Accordingly, the case of the light emitting cartridge 24 may be securely centered within the bore 98 by the first annular groove 78 and the second annular groove 86.

Figure 12:
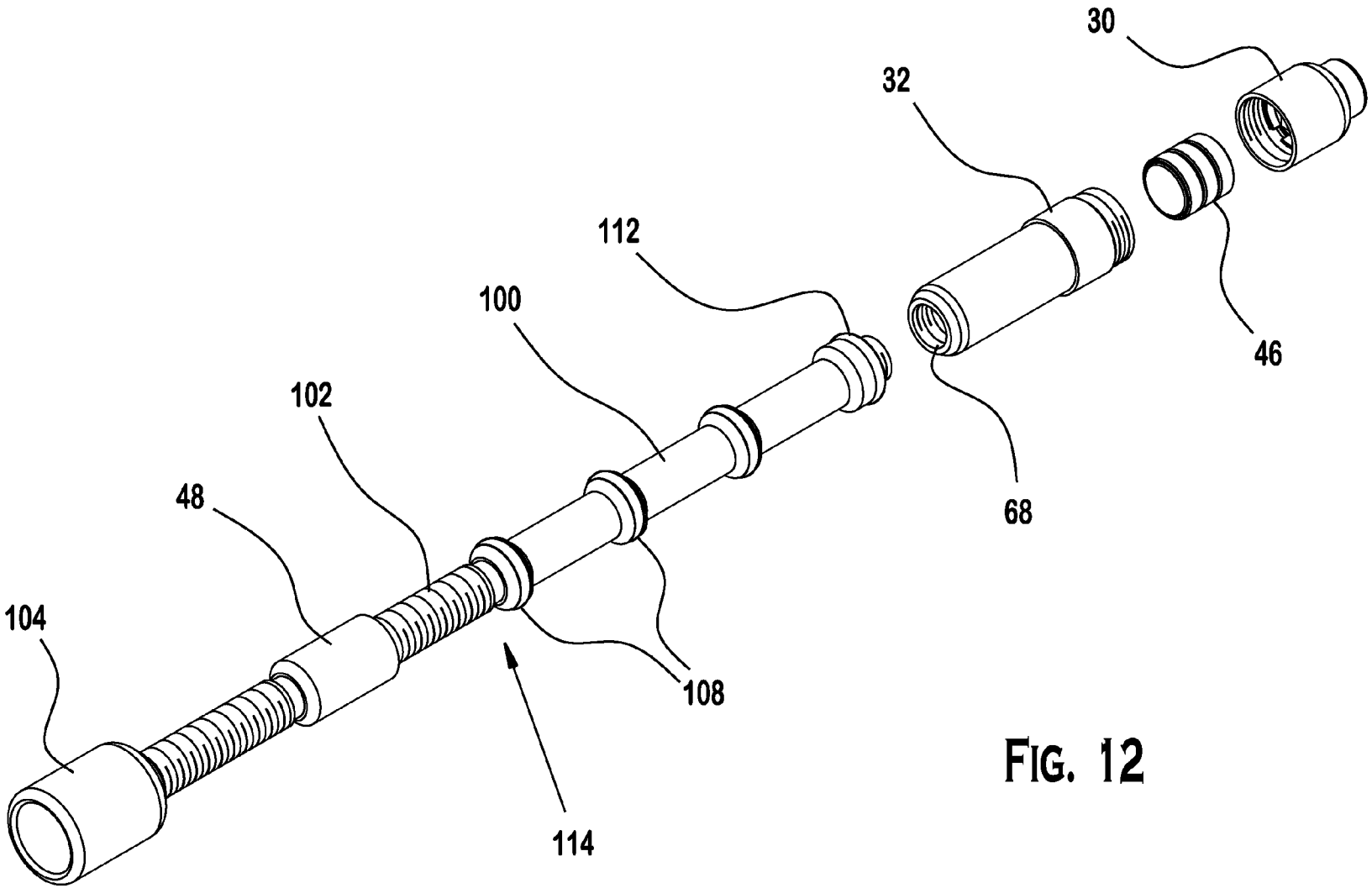
FIG. 12 is a partially exploded view of the light emitting cartridge of FIG. 11 with an accessory.

Referring to FIG. 12, a retaining pipe 100 may be connected to the light emitting cartridge 24. In addition, the retaining pipe 100 may end with an attachment element 102 (e.g., a screw thread) that accommodates a mating reversible beveled fastener 104. An extension 106 may be added to lengthen the retaining pipe. In another embodiment, the retaining pipe 100 may be integral to the light emitting cartridge 24. In general, the retaining pipe 24 is long enough to protrude out of the front end of the barrel such that the beveled fastener 104 can be attached to the retaining pipe 100, and tightened against the muzzle. In this manner, the beveled fastener 104 may advance down the retaining pipe to center and secure the light emitting cartridge 24 securely against the distal part 14. The retaining pipe assembly 114 also may shield the light emitting mechanism 28 of cartridge 24 from hot gases and particulates from the blank cartridge discharge.

Additionally, O-rings 108 may be placed on the retaining pipe 100 in order to prevent contact between the barrel sidewall near the muzzle and the deployed retaining pipe 100. One O-ring 112 may be positioned at the end of the retaining pipe 100. This O-ring 112 may prevent the threaded connection between retaining pipe 100 and the light emitting cartridge 24 from seizing due to operational vibrations during use.

In use, a blank cartridge (for example, a SecuriBlank® cartridge from Simunition®) is placed in the chamber 74 of the training barrel 10 that has been assembled into an operative firearm. The user aims the firearm and pulls the trigger. The blank cartridge is fired, and the resulting pressure inside the barrel 116 activates the actuator 26 of the light emitting cartridge 24. In response, the light emitting cartridge 24 emits a red laser pulse 68 which may register as a user "hit" in a training aid system or gaining system, while maintaining the perception of live firing (noise, smoke and recoil). The hot gases and any particles from the used blank cartridge are discharged from the training barrel 10 via the passages 84*a*, 84*b*, which may be configured to adjust the recoil power, cycling and loading of the weapon.

While it is apparent that the illustrative embodiments of the invention disclosed herein fulfill the objectives of the present invention, it is appreciated that numerous modifications and other embodiments may be devised by those skilled in the art. Additionally, feature(s) and/or element(s) from any embodiment may be used singly or in combination with other embodiment(s). Therefore, it will be understood that the appended claims are intended to cover all such modifications and embodiments, which would come within the spirit and scope of the present invention.

What is claimed is:

1. A training barrel having a central axis for housing a light emitting insert comprising:

an elongate member which comprises a first end, a second end, and a first internal surface extending from the first end through the elongate member to the second end which comprises a first segment abutting the first end which defines a first volume having a first cross sectional area perpendicular to the central axis, a second segment adjacent the first segment which defines a second volume having a second cross sectional area perpendicular to the central axis, the second cross sectional area being less than the first cross sectional area, a third segment proximate the second segment which defines a third volume having a third cross sectional area perpendicular to the central axis, the third cross sectional area being greater than the second cross sectional area, a fourth segment situated between the third segment and the second end which defines a fourth volume having a fourth cross sectional area perpendicular to the central axis, the fourth cross sectional area being less than the third cross sectional area; wherein the third segment is configured and dimensioned to receive a light emitting insert, and such that the fourth and second segments are configured and dimensioned to secure the light emitting insert in the third segment.

2. The training barrel of claim 1, wherein the elongate member is separable into a proximal part and a distal part, and the first, second, and third segments are disposed in the proximal part and the fourth segment is disposed in the distal part.

3. The training barrel of claim 2, wherein the proximal part further comprises a first screw thread, and the distal part further comprises a second screw thread such that the second screw thread and the first screw thread mate to secure the distal part to the proximal part.

4. The training barrel of claim 3, wherein the first screw thread is proximate the third segment and the second screw thread is proximate the fourth segment.

5. The training barrel of claim 3, wherein the proximal part further comprises an exterior surface and a second interior surface which extends from the exterior surface to the first screw thread.

6. The training barrel of claim 5, wherein the distal part further comprises a third interior surface which extends toward the first interior surface from the second screw thread.

7. The training barrel of claim 6, further comprising a fastening element disposed in the second and third interior surfaces.

8. The training barrel of claim 1, wherein the first segment is configured and dimensioned to receive a source of compressed gas.

9. The training barrel of claim 8, wherein the first segment is configured and dimensioned to receive a blank cartridge.

10. The training barrel of claim 9, further comprising a light emitting insert disposed in the third segment, wherein the light emitting insert is a light emitting cartridge which comprises a laser diode that emits light having a dominant wavelength of between approximately 610 nm and 760 nm.

11. The training barrel of claim 1, wherein the elongate member further comprises a fifth segment disposed between the fourth segment and the third segment which defines a fifth volume having a fifth cross sectional area perpendicular to the central axis, the fifth cross sectional area being greater than the fourth cross sectional area.

12. The training barrel of claim 11, wherein the fifth segment is located in the distal part.

13. The training barrel of claim 1, wherein the elongate member further comprises a sixth segment disposed between the fourth segment and the second end which defines a sixth volume having a sixth cross sectional area perpendicular to the central axis, the sixth cross sectional area being greater than the fourth cross sectional area.

14. The training barrel of claim 13, wherein the second segment includes a vent in fluid communication with the sixth segment.

15. The training barrel of claim 1, wherein the first segment has circular cylindrical shape and the diameter of the first cross sectional area is between approximately 0.1 inches and 0.5 inches.

16. The training barrel of claim 1, wherein the distance between the first and second end is between approximately 3 inches and 6 inches.

17. The training barrel of claim 1, wherein the elongate member is formed from an alloy.

18. The training barrel of claim 1, wherein the elongate member is a drop in replacement part for a handgun.

19. A method for simulating live fire training with a firearm comprising:

providing a training barrel of claim 1;

installing a light emitting cartridge into the training barrel;

assembling the training barrel into a firearm;

placing a blank cartridge into the training barrel;

firing the blank cartridge;

activating the light emitting cartridge in response to the firing of the blank cartridge; and emitting a pulse of light and gases to simulate live fire training.

* * * * *